US005860280A

United States Patent [19]

Recine, Sr. et al.

[11] Patent Number: 5,860,280

[45] Date of Patent: Jan. 19, 1999

[54] LIQUID COOLING SYSTEM WITH SOLID MATERIAL FORMATION CONTROL AND METHOD OF MANUFACTURE

[75] Inventors: Leonard J. Recine, Sr., Plano; James L. Bierschenk, Rowlett, both of Tex.

[73] Assignee: Marlow Industries, Inc., Dallas, Tex.

[21] Appl. No.: 888,114

[22] Filed: Jul. 3, 1997

[51] Int. Cl.[6] ..... F25B 21/02

[52] U.S. Cl. ..... 62/3.64; 62/59; 62/400

[58] Field of Search ..... 62/3.63, 3.64, 62/59, 389, 394, 400

[56] References Cited

U.S. PATENT DOCUMENTS

| | | | |
|---|---|---|---|
| 2,943,452 | 7/1960 | Buchanan | 62/3 |
| 3,178,896 | 4/1965 | Sandsto | 62/3 |
| 4,320,626 | 3/1982 | Donnelly | 62/3 |
| 4,841,741 | 6/1989 | Hilton | 62/394 |
| 4,934,150 | 6/1990 | Fessler | 62/59 |
| 4,993,229 | 2/1991 | Baus et al. | 62/3.64 |
| 5,234,131 | 8/1993 | Griffin | 222/146.6 |
| 5,367,879 | 11/1994 | Doke et al. | 62/3.6 |
| 5,544,489 | 8/1996 | Moren | 62/3.64 |
| 5,619,856 | 4/1997 | Lee | 62/3.64 |

*Primary Examiner*—William Doerrler
*Attorney, Agent, or Firm*—Baker & Botts L.L.P.

[57] ABSTRACT

A liquid cooling system (10) includes a container (12) for storing a liquid (13) and a cooling element (14) disposed within the container (12) for cooling the liquid (13). The system (10) also includes a heat exchanging system (16) for cooling the cooling element (14) and a control device (38) disposed proximate the cooling element(14) for controlling solidification of the liquid (13) within the container (12). The control device (38) includes a first insulating region disposed between a portion of the cooling element (14) and a portion of the liquid (13). The first insulating region is formed from at least one thermally insulating material.

27 Claims, 2 Drawing Sheets

LIQUID COOLING SYSTEM WITH SOLID MATERIAL FORMATION CONTROL AND METHOD OF MANUFACTURE

TECHNICAL FIELD OF THE INVENTION

This invention relates in general to cooling of liquid and more particularly to a system for cooling liquid and controlling formation of solid material in a liquid container and a method of manufacturing the system.

BACKGROUND OF THE INVENTION

Liquid chillers, such as water chillers, are well known. A conventional water chiller includes a water reservoir and a method for cooling the water contained in the reservoir. Water chillers are typically found, for example, in athletic clubs, offices, and the home, and provide a cool liquid refreshment. In addition to providing liquid refreshment, liquid chillers may also be used to cool an ambient environment and have found applications in, for example, the semiconductor industry.

Liquid chillers may be divided into two categories. A first category of liquid chillers is characterized by a large thermal capacity that can quickly chill all of the liquid contained in an associated liquid reservoir. Such chillers may use, for example, compressors with a simple on/off control to cool the liquid. A second category of chillers is characterized by a relatively small chilling capacity in comparison to the thermal requirements of an associated liquid reservoir. One example of this second category of chillers is a thermoelectric-based cooling system. Another example is a compressor-based cooling system that includes an undersized compressor.

In chillers having a relatively small chilling capacity, it is often desirable to form solid material, such as ice, as a method of storing thermal energy for peak demand periods. For example, a water cooler may experience higher demand for cooling during a particular portion of the day than at other portions of the day. Conventional thermoelectric-based chillers may not be able to cool water received by the water cooler quickly enough to provide water that is cool during the entire peak period. To combat this problem, during off-peak times the cooler operates to form ice within a portion of the water reservoir. This ice formation allows for storing of energy that is later used during peak periods to cool the water in the liquid reservoir. During peak periods, as the liquid is consumed, ambient temperature water replaces the chilled water that has been consumed from the water reservoir. During peak periods, the ambient temperature water is more quickly cooled by the combination of the ice and the thermoelectric cooler than cooling that would take place in the absence of the ice. The formation of ice allows a large amount of energy to be stored because of the large amount of energy associated with a phase change from water to ice. Therefore, in this manner, lower capacity chillers may provide chilled liquid to users both during peak periods and off-peak periods. Such a system, therefore, reduces the size of a compressor that might be required or allows the use of alternative cooling systems, such as thermoelectric-based systems.

Although formation of ice allows the storage of energy for later use during peak periods, the formation of ice also creates problems. For example, operating a thermoelectric cooler or a compressor-based cooler in a manner that creates ice may cause the entire liquid reservoir to freeze, thus, in the example of a water cooler for providing a cool potable liquid, restricting the ability of users to receive liquid refreshment upon demand. In addition, particular portions of the liquid reservoir may freeze, such as portions near a fluid outlet, also inhibiting users from receiving liquid refreshment on demand.

In order to attempt to overcome these problems associated with the formation of ice as a method of storing energy for peak demand periods, several control systems have been developed. In one control system, the temperature of a cooling element is controlled based on the amount of ice formed. Sensors, such as optical sensors, may be used to detect the formation of ice, and the control system may appropriately adjust the temperature of a cooling element when a desirable amount of ice has been formed. However, such a system may experience disadvantages. For example, once ice is formed, reliably controlling the temperature of the cooling element and additional ice formation is difficult. In another type of control system, optical sensors detect the presence of ice on a cooling element, and ice is discharged from the surface of the cooling element after the ice has formed. Such discharge allows better control of ice formation on the cooling element because the insulative effect of the ice on the cooling element is removed as a complicating parameter. However, such systems do suffer the problem of filling the reservoir with ice, which may inhibit discharge of liquid refreshment to a user on demand or otherwise adversely affect the performance of liquid chillers used to cool an ambient environment.

SUMMARY OF THE INVENTION

In accordance with the present invention, a liquid cooling system for controlling the formation of solid material in a liquid container and a method of manufacturing the system are provided that address the disadvantages and problems associated with previous liquid cooling systems.

A liquid cooling system according to the teachings of the present invention preferably includes a container for storing the liquid and a cooling element disposed within the container for cooling the liquid. The system also includes a heat exchanging system for cooling the cooling element and a control device disposed proximate the cooling element for controlling solidification of the liquid within the container. The control device includes a first insulating region disposed between a portion of the cooling element and a portion of the liquid. The first insulating region is formed from at least one thermally insulating material.

A method of manufacturing a liquid cooling system for cooling a liquid and for controlling solidification of the liquid according to the teachings of the present invention preferably includes forming a liquid container and inserting a cooling element into the container. The method also includes attaching a cooling element to a heat exchanging system disposed on the exterior of the container and locating a control device proximate the cooling element to at least partially divide the container into a first region with liquid adjacent to the cooling element and a second region with liquid remote from the cooling element.

The invention provides several technical advantages. For example, a relatively small capacity heat exchanging system can be used to chill a relatively large amount of liquid by forming a solid material, such as ice, to assist in chilling the liquid. In addition, according to the invention, ice formation may be controlled to prevent blockages in liquid flow. Furthermore, the invention allows for selective insulation of various regions within a liquid container. This selective insulation prevents ice formation in certain regions of the liquid container and allows thermal transfer to other regions to promote the formation of solid material, such as ice. This selective insulation promotes solid material formation in desirable regions of a liquid container and inhibits solid material formation in regions of a liquid container where solid material formation is problematic.

The invention also allows the above-described advantages to be accomplished through the use of inexpensive techniques, not requiring expensive control circuitry or sensors. Furthermore, according to the teachings of the invention, the amount of solid material formation, such as ice, can be easily and selectively tailored based on the requirements of the liquid cooler. For example, formation of a relatively large amount of solid material may be promoted by providing a relatively large control device within a liquid container.

BRIEF DESCRIPTION OF THE DRAWINGS

For a more complete understanding of the present invention and the advantages thereof, reference is now made to the following written description taken in conjunction with the accompanying drawings, in which.

DETAILED DESCRIPTION OF THE INVENTION

Figure 1:
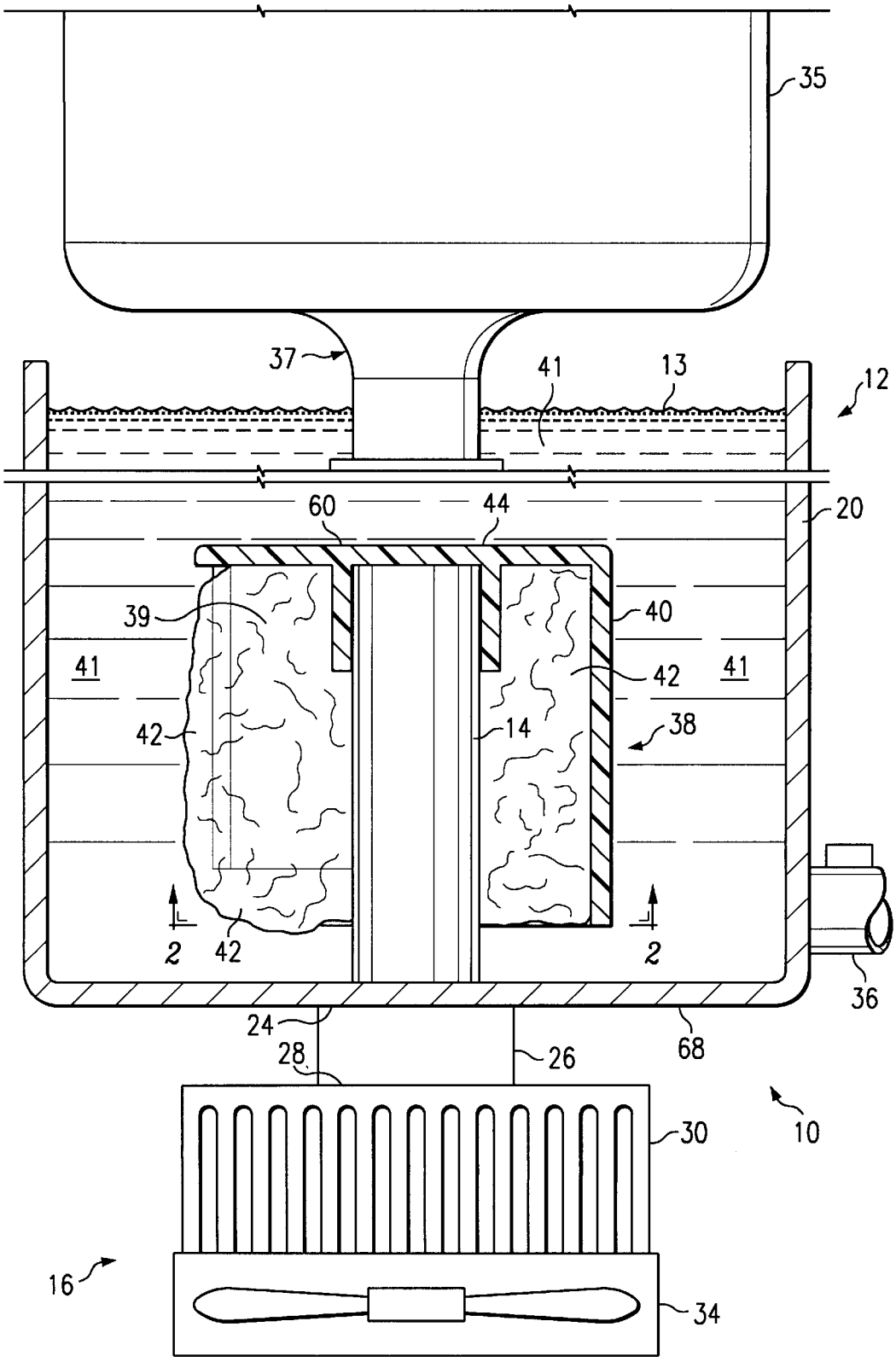
FIG. 1 is a schematic drawing showing an elevation view of a liquid cooling system according to the teachings of the present invention.
Figure 2:
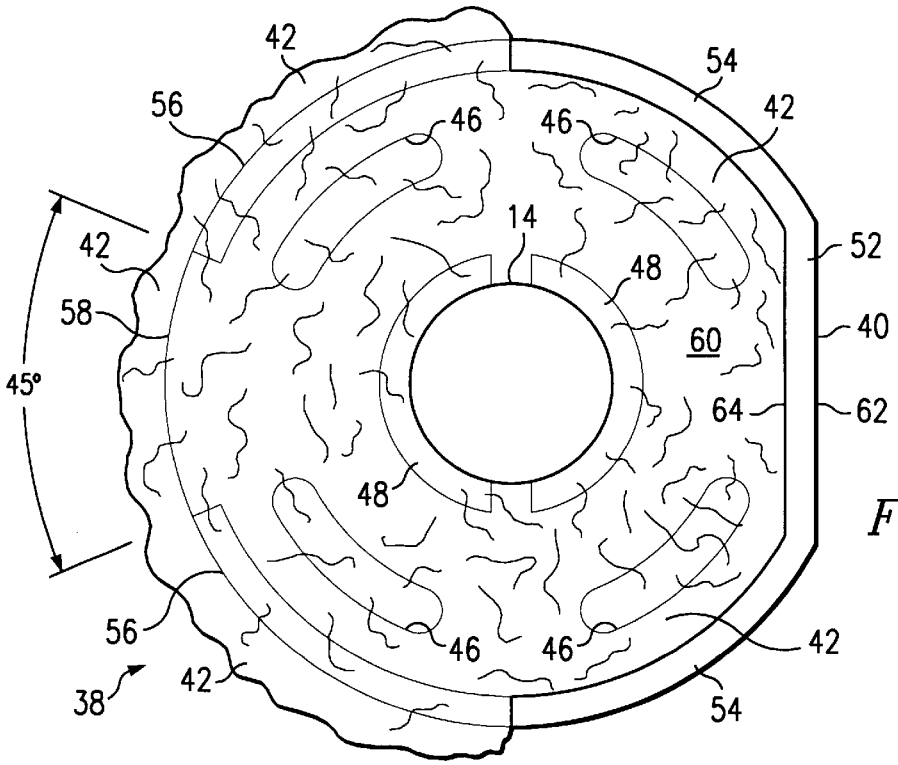
FIG. 2 is a schematic drawing in section along the lines 2—2 of FIG. 1, showing additional details of the control device shown in FIG. 1.
Figure 3:
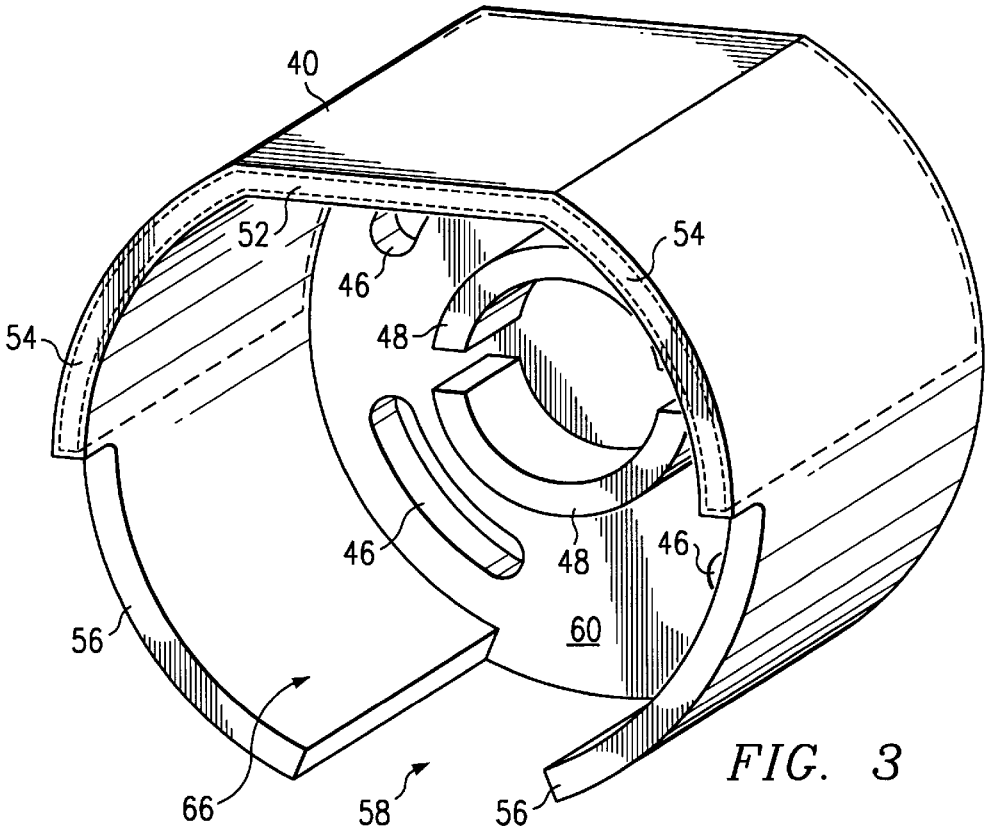
FIG. 3 is a perspective view of the control device shown in FIG. 1, showing additional details of the control device.

A preferred embodiment of the present invention and its advantages are best understood by referring to FIGS. 1–3 of the drawings, like numerals being used for like and corresponding parts of the various drawings.

FIG. 1 is a schematic drawing showing an elevation view of a liquid cooling system 10 according to the teachings of the present invention. In the embodiment illustrated in FIG. 1, liquid cooling system 10 may include a container 12 for storing a liquid 13, a cooling element 14 disposed within container 12 for cooling liquid 13, a heat exchanging system 16 for selectively cooling element 14, and a control device 38 disposed proximate cooling element 14 for controlling the formation of solid material, such as solid material 42, from liquid 13 in container 12.

In the embodiment illustrated in FIG. 1, container 12 is generally cylindrical and includes a bottom wall 68; however, other configurations for container 12 may be used. Container 12 also includes a peripheral wall 20. Heat exchanging system 16 may be any type of heat exchanger operable to cool a cooling element. In the embodiment illustrated in FIG. 1, heat exchanging system 16 utilizes a thermoelectric device 26 to cool cooling element 14.

Thermoelectric devices (sometimes referred to as thermoelectric coolers) satisfactory for use with the present invention, are available from Marlow Industries, Inc., located in Dallas, Tex. U.S. Pat. No. 4,855,810, entitled Thermoelectric Heat Pump, and U.S. Pat. No. 5,064,476, entitled Thermoelectric Cooler and Fabrication Method, show various details associated with fabrication of thermoelectric devices satisfactory for use with the present invention. These patents are incorporated by reference for all purposes within this application.

Thermoelectric device 26 has a cold side 24 for cooling element 14 and a hot side 28. Cold side 24 is thermally coupled to cooling element 14 for cooling cooling element 14. Hot side 28 is thermally coupled to a heat sink 30 for dissipating heat generated by thermoelectric device 26. A fan 34 may be oriented proximate heat sink 30 operated to selectively control heat dissipation from heat sink 30, and therefore may affect the temperature of cooling element 14. Fan 34 may be a multispeed fan. Fluid container 12 may contain an outlet 36 for dispensing liquid 13 and an inlet 37 for filling container 12 with additional liquid 13. Inlet 37 may be associated with a liquid bottle 35. The teachings of the invention can also be combined with other ice formation prevention techniques to enhance existing technologies.

According to the invention, control device 38 is disposed proximate cooling element 14 for controlling the formation of solid material 42 from liquid 13 that may occur due to reducing the temperature of liquid 13 below its freezing point. If liquid 13 is water, solid material 42 is ice. In the embodiment illustrated in FIG. 1, control device 38 includes a front insulating region 40 facing outlet 36 for inhibiting formation of solid material 42 from liquid 13 near outlet 36. Inhibiting solid material formation near outlet 36 is accomplished, at least in part, by the thermal insulative properties of front insulating region 40.

Referring now to FIGS. 2 and 3, additional details of control device 38 are shown. FIG. 2 illustrates a schematic drawing in section along lines 2—2 of FIG. 1, showing additional details of control device 38. FIG. 3 is a perspective view of control device 38, showing additional details of control device 38. Control device 38 may be formed from a variety of insulating materials, such as, for example, polyethylene, polystyrene, polypropylene, or other suitable insulating materials. Control device 38 partially insulates liquid 13 within an interior 39 of control device 38 from liquid 13 in an exterior region 41 of container 12 that is exterior control device 38. Therefore, solid material 42 is formed more readily within interior 39 than would otherwise form without control device 38 because heat transfer between cooling element 14 and liquid 13 is concentrated within the interior 39 of control device 38. Conversely, solid material 42 is less likely to form in portions of exterior region 41 because control device 38 allows less heat transfer between cooling element 14 and portions of liquid 13 in exterior region 41 than would otherwise take place without control device 38.

In the embodiment illustrated in FIGS. 2 and 3, control device 38 is formed with a generally cylindrical configuration having a flat front insulating region 40; however, control device 38 may be formed with a variety of suitable configurations to selectively insulate liquid 13 in particular regions of container 12 from cooling element 14 and to selectively allow heat transfer between liquid 13 in other regions of container 12 and cooling element 14.

Front insulating region 40 may include a first layer 62 and a second layer 64 separated by an insulating gap 52 for thermally insulating liquid 13 near outlet 36 from cooling element 14. Insulating gap 52 may be filled with a variety of substances, such as insulating materials, or left void. Thus, in one embodiment, front insulating region 40 may include two layers 62 and 64 of material separated by an insulating gap 52, which may include a different material than that used to form first layer 62 and second layer 64.

In the embodiment illustrated in FIGS. 1–3, control device 38 includes a rear aperture 58 and top apertures 46. Rear aperture 58 and top apertures 46 allow for greater transfer of thermal energy between liquid 13 and solid material 42 that may be formed proximate cooling element 14 in the regions of container 12 near rear aperture 58 and top apertures 46. In addition, rear aperture 58 allows for the formation of solid material outside control device 38. Rear aperture 58 may be formed with a variety of sizes; however, a size of approximately forty-five degrees, as illustrated in FIG. 2, has been found to be particularly advantageous for promoting solid material formation in interior 39 and inhibiting solid material formation portions of exterior region 41. Control device 38 may also include a bottom opening 66. Bottom opening 66 allows solid material 42 to form outside control device 38 proximate the lower portions of control device 38.

In this embodiment, control device 38 also includes curved front portions 54 and curved rear portions 56. Curved front portions 54 may include an insulating gap such as insulating gap 52, which may be filled with a variety of insulating materials. However, in this embodiment, curved rear portions 56 are formed without an insulating gap. Thus, curved rear portions 56 are designed to provide less thermal insulation between cooling element 14 and liquid 13 in the area of container 12 near curved rear portions 56 than the magnitude of the insulation provided between cooling element 14 and liquid 13 in the region of container 12 near curved front portions 54.

Thus, according to the teachings of the invention, control device 38 may include portions having selective insulative properties based on the orientation of the cooling element 14 and container 12. For example, in this embodiment, cooling element 14 is disposed through a bottom wall 68 of container 12, and container 12 is generally cylindrical with an outlet 36 near the junction of bottom wall 68 and peripheral wall 20. Therefore, control device 38 is designed to include front insulating region 40 disposed on the area of control device 38 nearest outlet 36. The use of front insulating region 40 separates liquid 13 in the region of container 12 near outlet 36 from cooling element 14. As illustrated in FIGS. 1–3, front insulating region 40 is flat, thus providing a greater distance between control device 38 and outlet 36 to inhibit solid material formation near outlet 36. Furthermore, as discussed above, front insulating region 40 includes an insulating gap 52, which provides additional thermal insulation between portions of liquid 13 proximate outlet 36 and cooling element 14. This additional thermal insulation inhibits solid material formation in regions where solid material formation is not desired. As illustrated in FIGS. 1 and 3, front insulating region 40 and curved front portions 54 may also be formed having a greater height than other portions of control device 38 to further insulate cooling element 14 from outlet 36.

To further provide selective insulating properties based on the orientation of cooling element 14 and container 12, curved front portions 54 may include an insulating gap, such as insulating gap 52 in front insulating region 40, to provide additional insulation to inhibit solid material formation outside control device 38 and promote solid material formation within control device 38. In the embodiment illustrated in FIGS. 1–3, front insulating region 40 and curved front portions 54 are oriented toward outlet 36 because, as discussed above, solid material formation near outlet 36 may be detrimental to the operation of liquid cooling system 10.

By contrast, control device 38 includes curved rear portions 56 that, in this embodiment, do not include an insulating gap. Thus, curved rear portions 56 allow more heat transfer between cooling element 14 and solid material 42, and liquid 13 in the region of container 12 outside control device 38 and proximate curved rear portions 56. Such additional heat transfer may be desired in regions of container 12 remote from outlet 36 because any formation of solid material in this region is less likely to be detrimental to the performance of liquid cooling system 10 than any solid material formation near outlet 36. In addition, solid material formation in such regions allows for the storage of thermal energy that may be required during peak usage periods. Rear aperture 58 formed in control device 38 additionally allows solid material formation in regions remote from outlet 36.

A top surface 60 of control device 38 inhibits formation of solid material 42 above cooling element 14. Without such a top surface 60, ice might tend to form above cooling element 14 and form a "mushroom shape" extending to the peripheral wall 20 of the fluid container 12 and therefore blocking flow of liquid 13 within container 12. However, top apertures 46 formed in top surface 60 of control device 38 allow liquid 13 to flow over the top of solid material 42 formed around cooling element 14 and therefore help cool liquid 13 during peak usage periods. Rear aperture 58, which is disposed opposite outlet 36, allows solid material 42 to grow outside control device 38 and wrap around the exterior of control device 38. Thus, rear aperture 58 allows for a greater volume of solid material 42 to be formed than would likely form without such an aperture. However, as solid material 42 continues to wrap around the exterior of control device 38, solid material 42 comes into contact with curved front portions 54 and front insulating region 40, which as previously discussed, allow less heat transfer between cooling element 14 and the exterior of control device 38. Solid material formation in this region is therefore inhibited.

In one embodiment, control device 38 includes cooling element connecting members 48 for facilitating coupling of cooling element 14 with control device 38; however, it is not necessary for control device 38 to be coupled to cooling element 14. For example, control device 38 may be supported by container 12 without connection of cooling element 14 to control device 38.

In operation, heat exchanging system 16 may be operated to set the temperature of cooling element 14 below the freezing temperature of liquid 13. When cooling element 14 is at a temperature below the freezing temperature of liquid 13, liquid 13 in portions of container 12 will begin to freeze. Because control device 38 insulates portions of liquid 13 from cooling element 14, liquid 13 within interior 39 of control device 38 will begin to freeze before liquid 13 in exterior region 41 of container 12 outside control device 38. As solid material 42, such as ice, begins to form, it may fill the entire interior 39 partially enclosed by control device 38 and further form outside control device 38 through rear aperture 58 and through bottom opening 66. Solid material 42 may additionally begin to wrap around the exterior of control device 38. Ice formation in the region of container 12 between outlet 36 and cooling element 14 is inhibited, however, because control device 38 is formed with insulative properties that inhibit heat transfer between cooling element 14 and such liquid.

During peak usage periods, as liquid 13 is consumed, additional liquid is added to container 12. However, such additional liquid generally has a higher temperature than liquid 13. Therefore, the overall temperature of liquid 13 is raised. In some applications, without the formation of solid material 42, a cooling element, such as cooling element 14, may not reduce the temperature of liquid 13 to an acceptable level in a timely manner. However, because of the formation of solid material 42 according to the invention, thermal energy stored through such formation may be readily transferred to liquid 13 to reduce the temperature of liquid 13.

Formation of solid material 42 allows for storing a large amount of thermal energy because of the large amount of energy required to effect a phase change from liquid to solid. Thus, liquid 13 may be quickly cooled to acceptable temperatures for exiting outlet 36 and providing a cool refreshment. Control device 38 also serves as a partial thermal barrier between liquid 13 and solid material 42 to inhibit reducing the temperature of liquid 13 to too great an extent.

Although the present invention and its advantages have been described in detail, it should be understood that various changes, substitutions, and alterations can be made without departing from the spirit and scope of the invention as defined by the appended claims. For example, although the invention has been described in the context of a cooler containing a liquid for drinking, the invention may also be used for cooling liquid that is used to cool an ambient environment, rather than for consumption.

What is claimed is:

1. A liquid cooling system comprising:

a container for storing a liquid;

a cooling element disposed within the container for cooling the liquid;

a heat exchanging system for cooling the cooling element;

a control device disposed proximate the cooling element for controlling solidification of the liquid within the container, the control device comprising an insulating region disposed between a portion of the cooling element and a portion of the liquid, the insulating region formed from at least one thermally insulating material; and wherein the control device further comprises an enclosure having at least one opening or aperture extending therethrough.

2. The liquid cooling system of claim 1 wherein the liquid comprises potable water and the control device regulates formation of ice adjacent the cooling element.

3. The liquid cooling system of claim 1 wherein the heat exchanging system comprises a thermoelectric device.

4. The liquid cooling system of claim 1 wherein the control device further surrounds at least a portion of the cooling element and defines in part a thermal barrier between liquid in the container adjacent to the cooling element and liquid remote from the cooling element.

5. A liquid cooling system comprising:

a container for storing a liquid;

a cooling element disposed within the container for cooling the liquid;

a heat exchanging system for cooling the cooling element;

a control device disposed proximate the cooling element for controlling solidification of the liquid within the container, the control device comprising an insulating region disposed between a portion of the cooling element and a portion of the liquid, the insulating region formed from at least one thermally insulating material; and wherein the control device further comprises a plurality of walls, at least two of the walls having a different thermal conductance from each other to regulate solicitation of the liquid in particular areas of the liquid container.

6. The liquid cooling system of claim 1 wherein the control device further comprises an enclosure formed with selected portions having a lesser thermal conductance than other portions of the enclosure to selectively insulate selected portions of the liquid more than other portions of the liquid from the cooling element.

7. The liquid cooling system of claim 1 wherein the control device further comprises an enclosure formed with selected portions having a lesser thermal conductivity than other portions of the enclosure to selectively insulate selected portions of the liquid more than other portions of the liquid from the cooling element.

8. The liquid cooling system of claim 1 wherein the control device further comprises a plurality of walls, at least two of the walls having a different thermal conductance from each other to regulate solidification of the liquid in particular areas of the liquid container.

9. The liquid cooling system of claim 8 wherein at least one of the plurality of walls comprises two layers separated by a gap to inhibit unwanted solidification of the liquid.

10. The liquid cooling system of claim 6 wherein the control device further comprises:

a top surface having at least one aperture;

a front surface comprising a gap;

a curved surface having a second gap in a portion of the curved surface; and a connecting member for connecting the control device to the cooling element.

11. The cooling system of claim 6 wherein the cooling element is generally cylindrical and the connecting member is operable to couple with the generally cylindrical cooling element.

12. A liquid cooling system comprising:

a container for storing a liquid, the container having an outlet;

a cooling element disposed at least partially within the container for cooling the liquid;

a thermoelectric heat exchanging system for cooling the cooling element, the thermoelectric heat exchanging system comprising at least one thermoelectric device;

a control device disposed proximate the cooling element for controlling solidification of the liquid within the container, the control device comprising a first insulating region disposed between a portion of the cooling element and the outlet, the first insulating region formed from at least one thermally insulating material; and wherein the control device further comprises a partial enclosure having at least one opening or aperture to allow liquid communication therethrough.

13. The liquid cooling system of claim 12 wherein the first insulating region further comprises two layers separated by a gap.

14. A liquid cooling system comprising:

a container for storing a liquid;

a cooling element disposed within the container for cooling the liquid;

a heat exchanging system for cooling the cooling element;

a control device disposed proximate the cooling element for controlling solidification of the liquid within the container, the control device comprising an insulating region disposed between a portion of the cooling element and a portion of the liquid, the insulating region formed from at least one thermally insulating material; and wherein at least one of the plurality of walls comprises two layers separated by a gap to inhibit unwanted solidification of the liquid.

15. The liquid cooling system of claim 12 wherein the first insulating region comprises a flat portion and two curved portions, the flat portion disposed proximate the outlet.

16. The liquid cooling system of claim 12 wherein the control device further comprises a second insulating region, the second insulating region having a thermal conductance greater than the first insulating region.

17. The liquid cooling system of claim 16 wherein the second insulating portion is formed with an opening opposite the flat region of the first insulating region.

18. The liquid cooling system of claim 17 wherein the second insulating region comprises two curved portions with the opening disposed between the curved portions.

19. The liquid cooling system of claim 12 wherein the control device further comprises a top surface having at least one aperture and the control device further comprises a peripheral wall.

20. The liquid cooling system of claim 12 wherein: the first insulating region further comprises:

a flat front surface having two layers separated by a gap, the flat front surface facing the outlet; and first and second curved surfaces disposed adjacent the flat front surface, the first and second curved surfaces having two layers separated by a gap, the first and second curved surfaces having a first height;

and the control device further comprises:

a second insulating region comprising third and fourth curved surfaces separated by an opening, the third and fourth curved surfaces having a second height, the second height less than the first height; and a top wall having at least one aperture formed therethrough, the top wall having a connecting member for connecting the control device to the cooling element.

21. The liquid cooling system of claim 20 wherein the second insulating region is formed having a generally semicircular configuration and wherein the opening separating the third and fourth curved surfaces is approximately 45 degrees of the second insulating region.

22. A method of manufacturing a liquid cooling system for controlling the solidification of a liquid, the method comprising the steps of:

forming a liquid container;

inserting a cooling element into the container;

attaching the cooling element to a heat exchanging system disposed on the exterior of the container;

locating a control device proximate the cooling element to at least partially divide the container into a first region with liquid adjacent to the cooling element and a second region with liquid remote from the cooling element; and wherein the step of locating a control device further comprises a control device having a plurality of apertures or openings to selectively allow transfer of thermal energy away from the first portion of the liquid container to the second region.

23. The method of claim 22 wherein the step of locating a control device further comprises varying the thermal conductance of selected portions of the control device to selectively allow more heat transfer from the second region to the first region in selected areas of the control device.

24. The method of claim 22 wherein the step of locating a control device comprises configuring the relative size of the control device and the liquid container to specify the relative size of the first region and the second region.

25. The method of claim 22 wherein:

the step of forming a liquid container further comprises forming a liquid container having an outlet; and the step of locating the control device further comprises configuring the control device to provide greater thermal insulation between the cooling element and the outlet than any insulation provided by the control device between the cooling element and a region of the liquid container opposite the outlet.

26. A liquid cooling system comprising:

a container for storing a liquid, the container having an outlet;

a cooling element disposed at least partially within the container for cooling the liquid;

a thermoelectric heat exchanging system for cooling the cooling element, the thermoelectric heat exchanging system comprising at least one thermoelectric device;

a control device disposed proximate the cooling element for controlling solidification of the liquid within the container, the control device comprising a first insulating region disposed between a portion of the cooling element and the outlet, the first insulating region formed from at least one thermally insulating material; and wherein the control device further comprises a second insulating region, the second insulating region having a thermal conductance greater than the first insulating region.

27. A method of manufacturing a liquid cooling system for controlling the solidification of a liquid, the method comprising the steps of:

forming a liquid container;

inserting a cooling element into the container;

attaching the cooling element to a heat exchanging system disposed on the exterior of the container;

locating a control device proximate the cooling element to at least partially divide the container into a first region with liquid adjacent to the cooling element and a second region with liquid remote from the cooling element; and wherein the liquid container comprises a liquid outlet and wherein the step of providing the control device further comprises configuring the control device to inhibit freezing of the liquid in a region of the liquid container proximate the outlet.

* * * * *